US008354056B2

(12) United States Patent
Barrett

(10) Patent No.: US 8,354,056 B2
(45) Date of Patent: Jan. 15, 2013

(54) REFRACTORY COMPONENT WITH LOCKING SURFACE AND METHOD OF FORMING THE SAME

(75) Inventor: Ronald L. Barrett, Fenelton, PA (US)

(73) Assignee: North American Refractories Co., Moon Township, PA (US)

( * ) Notice: Subject to any disclaimer, the term of this patent is extended or adjusted under 35 U.S.C. 154(b) by 665 days.

(21) Appl. No.: 12/022,417

(22) Filed: Jan. 30, 2008

(65) Prior Publication Data

US 2009/0191423 A1 Jul. 30, 2009

(51) Int. Cl.
*C21B 7/04* (2006.01)
*B32B 15/00* (2006.01)

(52) U.S. Cl. ..... 266/280; 266/283; 266/286; 428/660

(58) Field of Classification Search ..... 52/596; 266/280, 283, 286; 501/94; 164/10, 519; 428/660; *C21B 7/04, 7/06; C21C 5/04; E04B 5/04; E04C 2/04*
See application file for complete search history.

(56) References Cited

U.S. PATENT DOCUMENTS

| | | | | |
|---|---|---|---|---|
| 2,727,737 | A * | 12/1955 | Dole | 266/138 |
| 3,800,014 | A | 3/1974 | Brichard | 264/30 |
| 4,473,983 | A * | 10/1984 | Vance | 52/378 |
| 2003/0201588 | A1 * | 10/2003 | Peretz et al. | 266/286 |

* cited by examiner

*Primary Examiner* — Stuart Hendrickson
*Assistant Examiner* — Alexander Polyansky
(74) *Attorney, Agent, or Firm* — Kusner & Jaffe

(57) ABSTRACT

A method of securing a precast refractory shape within a refractory structure, comprising the steps of forming a precast refractory shape by casting a refractory shape to have a plurality of spaced-apart cavities formed in an outer surface thereof; positioning the precast refractory within a refractory structure; and casting a refractory material around the precast refractory shape such that the refractory material covers the outer surface of the precast refractory and fills the cavities.

11 Claims, 3 Drawing Sheets

REFRACTORY COMPONENT WITH LOCKING SURFACE AND METHOD OF FORMING THE SAME

FIELD OF THE INVENTION

The present invention relates to precast refractory shapes and, more particularly, to precast refractory shapes having external surfaces that facilitate locking the precast refractory shape in a surrounding refractory material.

BACKGROUND OF THE INVENTION

In the refractories industry, the term "precast shapes" has been adopted to refer to articles made from castable materials that are supplied to an end user in a form or shape ready to be installed where used. Some precast refractory shapes are designed to be embedded within a surrounding refractory material. An example of such a precast refractory shape is a well block that is used in a ladle bottom. The well block is typically placed in a ladle bottom, and a refractory material is cast thereabout. To insure that the well block is secured within the surrounding cast material, it is conventionally known to form an outwardly-extending, annular flange. When the well block is placed into the ladle bottom and the refractory material is cast thereabout, the flange or projection extends into the surrounding castable, thereby holding the well block in place once the surrounding castable has set.

It is also known to form the well block to have a slightly conical shape, wherein the lower end of the block is slightly larger than the upper end of the block. The taper on the well block acts as a locking mechanism to prevent upward movement of the precast shape once the surrounding castable is in place.

A problem with the foregoing designs and methods of locking precast shapes into a surrounding refractory is that a flange or protrusion disposed around the lower end of a precast shape does not prevent portions above the flange from separating and floating upwardly should cracks develop in the refractory shape above the flange or protrusion. Tapered shapes may prevent separation of cracked shapes, but tapered shapes are not suitable in all applications.

The present invention overcomes these and other problems and provides a precast refractory shape having surface means for fixedly securing the precast shape in a surrounding refractory material and a method of forming same.

SUMMARY OF THE INVENTION

In accordance with a preferred embodiment of the present invention, there is provided a method of securing a precast refractory shape within a refractory structure, comprising the steps of:

forming a precast refractory shape by casting a refractory shape to have a plurality of spaced-apart cavities formed in an outer surface thereof;

positioning the precast refractory within a refractory structure; and casting a refractory material around the precast refractory shape such that the refractory material covers the outer surface of the precast refractory and fills the cavities.

In accordance with another aspect of the present invention, there is provided a precast shape for use within a surrounding refractory material. The shape is formed of a refractory material and having an outer surface adapted to be embedded in the surrounding refractory material. The outer surface has a plurality of spaced-apart cavities formed therein to define recesses in the outer surface of the precast shape.

An advantage of the present invention is a precast refractory shape designed to be embedded in a surrounding refractory material.

Another advantage of the present invention is a precast refractory shape as described above having surface means along the outer surface thereof, which surface means facilitate locking engagement between the precast shape and the surrounding refractory material.

Another advantage of the present invention is a precast refractory shape as described above having a plurality of spaced-apart, discrete cavities formed along the outer surface of the precast refractory shape.

A still further advantage of the present invention is a precast refractory shape as described above, wherein the entire embedded portion of the precast refractory shape is fixedly locked within the surrounding refractory material.

A still further advantage of the present invention is a precast refractory shape as described above that does not require forming outward projecting flanges or projections to lock the precast shape in the surrounding refractory material.

Another advantage of the present invention is a method of forming the precast refractory shape as described above.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
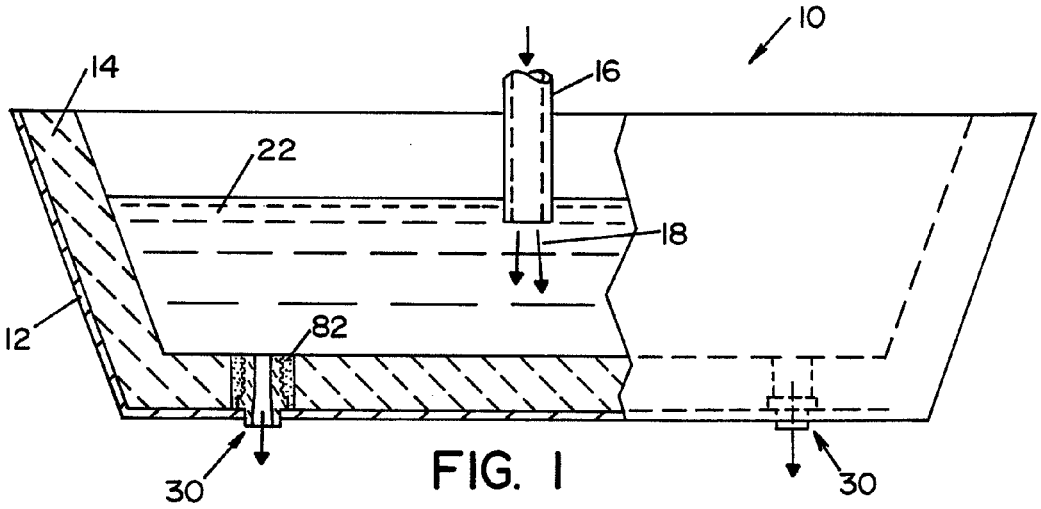
FIG. 1 is a partially sectioned, side-elevational view of a tundish showing well blocks therein.

Referring now to the drawings wherein the showings are for the purpose of illustrating preferred embodiments of the invention only and not for the purpose of limiting same, the present invention relates to precast refractory shapes and, more specifically, to precast refractory shapes designed to be embedded within a surrounding refractory material. The present invention will be described with respect to a well block for a tundish used in a metal-making process. As will be appreciated upon further reading of this specification, the present invention may find advantageous application in forming other precast refractory shapes for use in other refractory applications.

FIG. 1 shows a conventional tundish 10 for use in a steelmaking process. Tundish 10 has an outer metallic shell 12 and an inner refractory lining 14. A ladle shroud 16 is positioned above tundish 10 to direct a stream 18 of molten metal from a ladle (not shown) into tundish 10 to form a molten metal bath 22. Tundish 10 includes a pair of well blocks 30 to allow molten metal from bath 22 to enter molds (not shown), as is conventionally known. Well blocks 30 are precast refractory shapes formed of a first refractory material.

Figure 2:
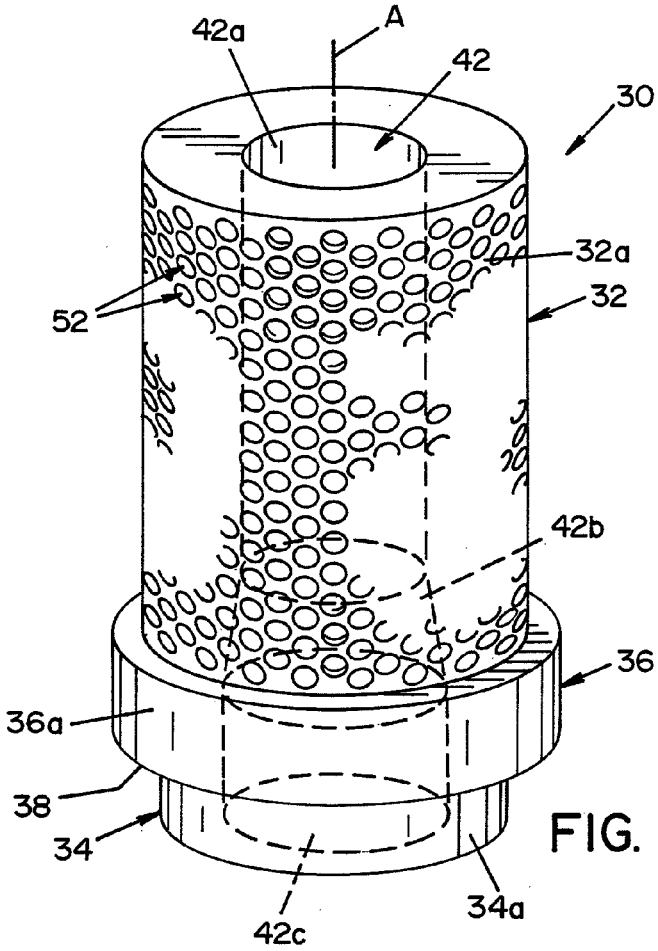
FIG. 2 is a perspective view of a precast well block, illustrating a preferred embodiment of the present invention.
Figure 3:
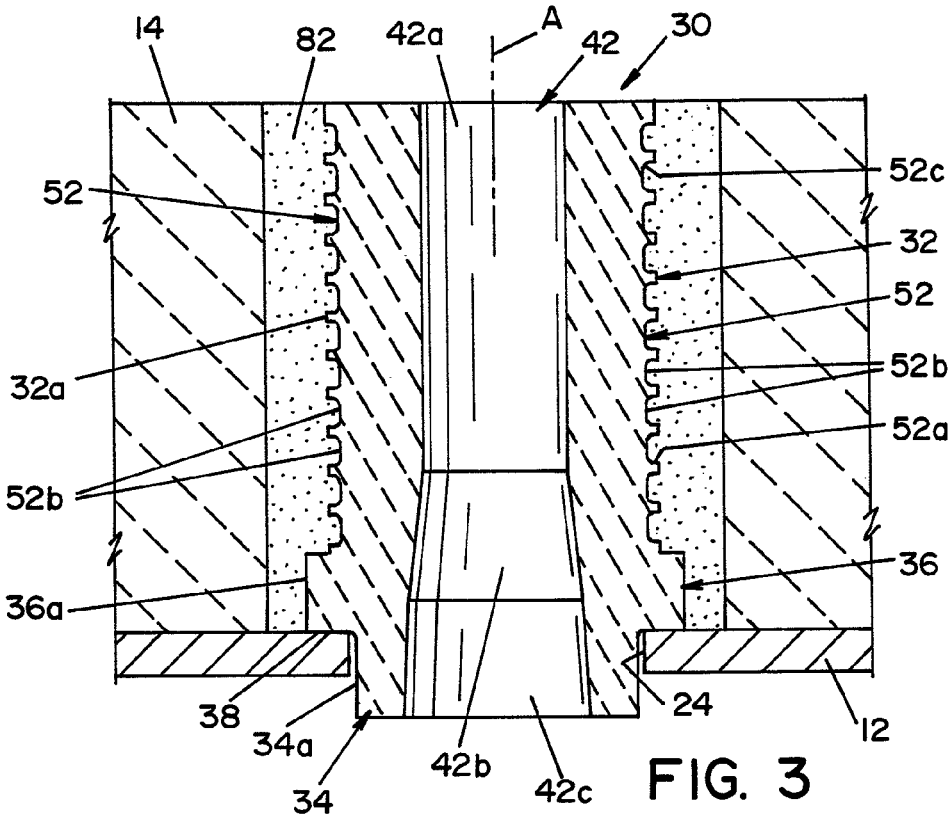
FIG. 3 is a sectional view of a well block as shown in FIG. 2 embedded within a surrounding refractory material.
Figure 4:
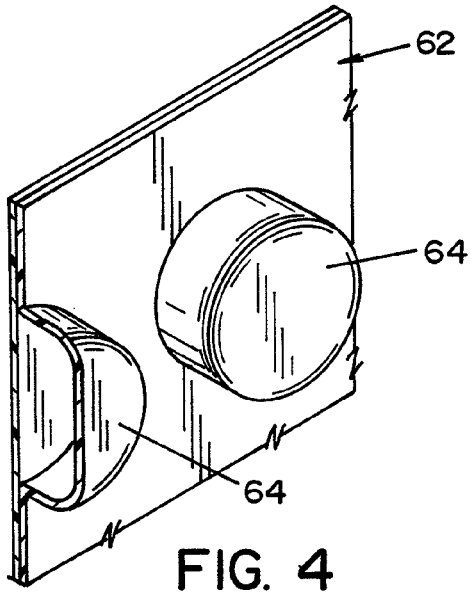
FIG. 4 is a perspective view of a portion of a mold for forming locking cavities in the surface of a refractory precast shape.

A well block 30, illustrating a preferred embodiment of the present invention, is shown in FIG. 2. As best seen in FIGS. 2 and 3, well block 30 is a tubular member having a generally cylindrical shape. In the embodiment shown, well block 30 is symmetrical about a central axis, designated "A" in the drawings. Well block 30 includes a major body portion 32, a lower-end portion 34, and an intermediate flange portion 36. An internal passageway 42 extends axially through well block 30. Passageway 42 includes a cylindrical portion 42*a* and two flared, outwardly extending, lower-end portions 42*b*, 42*c*.

Lower-end portion 34 of well block 30 has a cylindrical outer surface 34*a* that is dimensioned to extend through an opening 24 in metallic shell 12 of tundish 10. Flange portion 36 extends outwardly from lower-end portion 34 and defines a downward-facing annular surface 38, best seen in FIG. 3, that abuts and engages the inner surface of metallic shell 12. In the embodiment shown, flange portion 36 has a cylindrical outer surface 36*a*.

Major body portion 32 comprises a major portion of well block 30. Major body portion 32 has a cylindrical outer surface 32*a*. It is contemplated that major body portion 32 may be formed such that outer surface 32*a* is slightly conical, i.e., having a larger lower end that tapers to a smaller upper end, as described in the background above.

A plurality of spaced-apart cavities 52 is formed in the outer surface 32*a* of major body portion 32. In the embodiment shown, cavities 52 have like dimensions and configurations, and each cavity 52 is generally cylindrical in shape. More specifically, each cavity, best seen in FIG. 3, has a cylindrical side portion 52*a* and a flat bottom portion 52*b*. Side portion 52*a* is connected to the bottom portion 52*b* by a radiused or contoured corner 52*c*. In one embodiment of the present invention, each cavity 52 is dimensioned wherein cylindrical side portion 52*a* has a diameter "D" of about 1 inch. Each cavity 52 has a depth "d" equal to about ½ inch. It is contemplated that the depth of each cavity 52 may vary. It is also contemplated that each cavity 52 may have a depth less than that shown in FIG. 3. In this respect, each cavity 52 may have a diameter "D" ranging from about ¼ inch to about three inches, and a depth "d" ranging from about 1/32 inch to about two inches. A spacing "S" between adjacent cavities 52 ranges from about 1/32 inch to about 2 inches.

Based upon the foregoing, cavities 52 within surface 32*a* are dimensioned and are of such number to produce a "cavity density" of between 6 cavities and 1,920 cavities 52 per square foot of surface area of outer surface 32*a*. Each cavity 52 preferably defines a surface opening in outer surface 32*a*, ranging between 0.049 square inches ("D" equals ¼ inch) and 7.069 square inches ("D" equals 3 inches).

FIGS. 2 and 3 show well block 30 having cavities 52 of like size and configuration. It is contemplated that cavities 52 may be different sizes and/or different configurations. In this respect, well block 30 may have cavities 52 that have a number of different sizes, i.e., diameters "D" and depth "d." Still further, while cavities 52 have generally cylindrical shapes, it is contemplated that cavities 52 may be comprised of other geometric shapes. By way of example, other shapes, such as spherical shapes, elliptical shapes, square shapes or parabolic shapes, may find advantageous application in forming cavities 52 in surface 32*a* of a precast refractory shape.

Referring now to a method of forming a precast refractory shape 30, a mold (not shown) is provided, having an internal cavity defining the external shape of the precast refractory shape to be formed. With respect to the embodiment shown in FIG. 2, the mold would have an interior cavity defining the outer shape of well block 30. The mold would have a generally cylindrical inner surface that conforms to outer surface 32*a* of major body portion 32. An internal cylindrical die section would be used to form passageway 42 through well block 30. The internal die section would be disposed relative to the mold, such that the remaining space within the mold cavity would define the desired shape of well block 30.

Figure 5A:
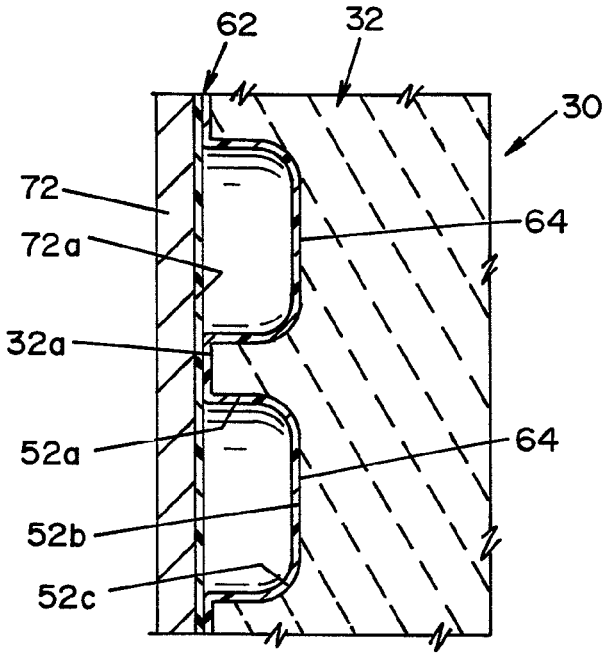
FIG. 5A is a sectional view showing the mold of FIG. 4 in use to form cavities along the outer surface of a precast refractory shape.
Figure 5B:
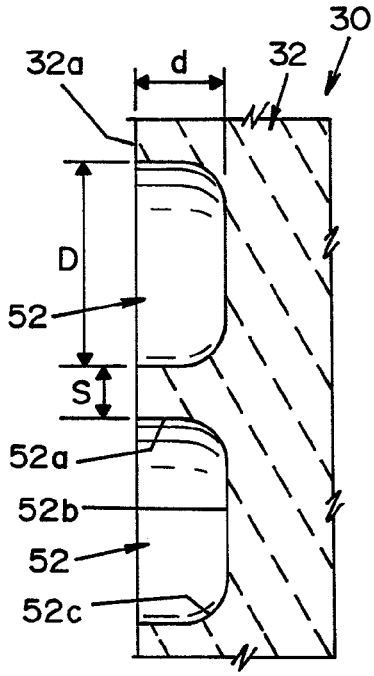
FIG. 5B is a sectional view showing the cavities formed in the surface of the precast shape by the mold shown in FIG. 4.

In accordance with one aspect of the present invention, a pattern layer 62 is provided to be disposed along the inner surface of the mold. FIG. 5A shows a section of a mold wall 72 having an inner surface 72*a* on which pattern layer 62 is positioned. Pattern layer 62 is dimensioned to be positioned along the cylindrical inner surface of mold wall 72. A plurality of spaced-apart projections or protrusions 64 is formed along one surface of pattern layer 62. In the embodiment shown, projections 64 are generally cylindrical in shape with rounded, contoured ends. Pattern layer 62 may be applied to the inner surface of the mold using double-sided adhesive tape.

Pattern layer 62 may be formed of a resilient, flexible polymer material, such as, by way of example and not limitation, rubber. In one embodiment of the present invention, Bubble Wrap®, air cellular cushion sheet manufactured by Sealed Air Corporation of Saddlebrook, N.J., is used to form pattern layer 62 that forms cavities 52 within well block 30. In the embodiment heretofore described, Bubble Wrapϕ cushion sheets having a bubble diameter of about 1¼ inch and a bubble height of about ½ inch are used. With pattern layer 62 in place, a first refractory material is poured into the mold to fill the cavity defined between the mold and the inner die section. As will be appreciated, projections 64 on the patterned layer define cavities 52 formed along outer surface 32*a* of major body portion 32, as illustrated in FIG. 5A. Well block 30 may be formed of many different types of refractory materials, such as, by way of example and not limitation, NARCON 70, D-CAST 85TMCC, NC-CAST MAXIMA, HP-CAST ULTRA, HP-CAST ULTRA C5, HP-CAST MAXIMA or WO-6740, all manufactured and sold by North American Refractories Company, Moon Township, Pa. The refractory castable is allowed to set and harden within the mold. Once the refractory castable is hardened, the first die section is removed and the mold is separated to allow the molded well block 30 to be removed therefrom.

Referring now to the operation of well block 30, as indicated above, well block 30 is disposed within tundish 10. As illustrated in FIG. 3, well block 30 is positioned such that cylindrical lower end portion 34 is disposed within opening 24 in metallic shell 12. As illustrated in FIG. 3, flange portion 36 rests upon and abuts metallic shell 12. In this respect, an opening is formed in inner refractory lining 14 to allow well block 30 to be disposed therein. The space between well block 30 and refractory lining 14 is filled with a refractory material 82 to secure well block 30 in place. Refractory material 82 may be comprised of a castable, a ramming mix or a plastic refractory. Examples of castables are HP-CAST ULTRA, HP-CAST MAXIMA or D-CAST 85 GOLD. Examples of ramming mix are NARPHOS 90 RAM or NARPHOS 85

RAM. All of these products are manufactured by North American Refractories Company, Moon Township, Pa. An example of a plastic is RUBY 20 PLASTIC. RUBY 20 PLASTIC is manufactured by Harbison-Walker Refractories Company, Moon Township, Pa. As illustrated in FIG. 3, surrounding refractory material 82 fills cavities 52 within surface 32*a* of well block 30, thus locking well block 30 in place in refractory lining 14.

As will be appreciated by those skilled in the art, the numerous cavities 52 disposed along major body portion 32 of well block 30 insure that the entire length of major body portion 32 is secured within the surrounding refractory material 82. In the event that cracking occurs above flange portion 36, filled cavities 52 of well block 30 prevent such section from separating from well block 30 or refractory 82. In addition, cavities 52 in well block 30 make it more difficult for liquid, molten steel to penetrate the joint between well block 30 and refractory material 82. In this respect, cavities 52 create a tortuous, convoluted path that the liquid steel must follow in order to penetrate the joint.

Figure 6:
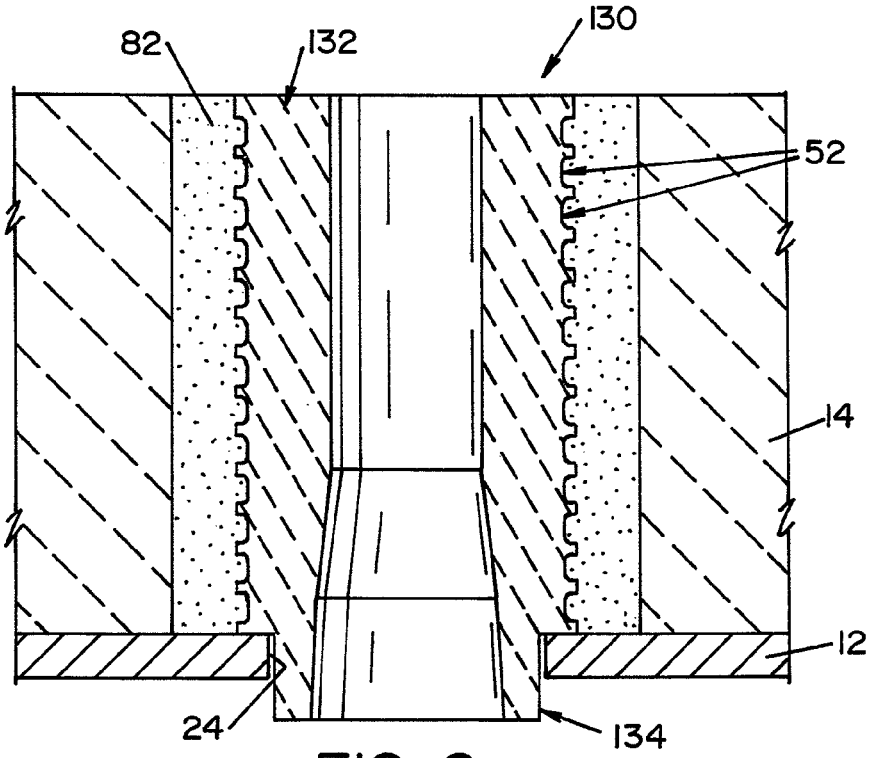
FIG. 6 is a sectional view of a precast well block according to an alternate embodiment of the present invention, showing the well block embedded within a surrounding refractory material.

Referring now to FIG. 6, an alternate embodiment of the present invention is shown. FIG. 6 shows well block 130 having a cylindrical lower end portion 134 that extends through opening 24 in metallic shell 12 and a major body portion 132 that extends along the remaining length of well block 130. In this respect, well block 130 does not include any outwardly projecting flange, as in well block 30, but rather has a generally cylindrical body portion 132 having a plurality of cavities 52 formed therein. Cavities 52 within well block 130 facilitate inner locking between well block 130 and surrounding refractory material 82, thereby maintaining well block 130 within refractory 82.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A refractory assembly comprised of:

a precast shape formed of a castable refractory material having an outer surface that includes a plurality of spaced-apart recesses in said outer surface, each spaced-apart recess having a single outer peripheral edge that surrounds each spaced-apart recess, each spaced-apart recess extends inwardly in a direction perpendicular to said outer surface of said precast shape and each peripheral edge of each spaced-apart recess is displaced from each neighboring peripheral edge of other adjacent spaced-apart recesses in a first direction and a second direction, a refractory material applied to said outer surface of said precast shape, said refractory material extending into said plurality of spaced-apart recesses to lock said precast shape into said refractory material and to define a tortuous, convoluted path between said outer surface of said precast shape and said refractory material.

2. The refractory assembly as defined in claim 1, wherein said recesses in said outer surface of said precast shape have like configurations.

3. The refractory assembly as defined in claim 1, wherein said recesses of said precast shape are spherical in shape.

4. The refractory assembly as defined in claim 1, wherein said recesses of said precast shape are cylindrical in shape.

5. The refractory assembly as defined in claim 1, wherein said precast refractory shape is cylindrical and tubular in shape and said recesses are formed along a cylindrical outer surface.

6. The refractory assembly as defined in claim 1, wherein said outer surface of said precast shape has between 6 recesses and 1,700 recesses per square foot of surface area.

7. The refractory assembly as defined in claim 1, wherein at least one portion of said tortuous, convoluted path is exposed to a molten metal.

8. The refractory assembly as defined in claim 1, wherein the spacing in the first direction between adjacent recesses ranges from about 1/32 inch to about 2 inches.

9. The refractory assembly as defined in claim 1, wherein said first direction is perpendicular to said second direction.

10. The refractory assembly as defined in claim 9, wherein said first direction is horizontal and said second direction is vertical.

11. The refractory assembly as defined in claim 1, wherein the spacing in the second direction between adjacent recesses ranges from about 1/32 inch to about 2 inches.

* * * * *